US009474917B1

(12) United States Patent
Al-Wasis

(10) Patent No.: US 9,474,917 B1
(45) Date of Patent: Oct. 25, 2016

(54) PNEUMATIC HAMMER

(71) Applicant: Adel Abdulmuhsen Al-Wasis, Safat (KW)

(72) Inventor: Adel Abdulmuhsen Al-Wasis, Safat (KW)

( * ) Notice: Subject to any disclaimer, the term of this patent is extended or adjusted under 35 U.S.C. 154(b) by 0 days.

(21) Appl. No.: 15/166,170

(22) Filed: May 26, 2016

(51) Int. Cl.

| | |
|---|---|
| ***B25D 17/06*** | (2006.01) |
| ***B25D 17/24*** | (2006.01) |
| ***B25D 9/14*** | (2006.01) |
| ***A62B 3/00*** | (2006.01) |
| ***B25D 9/16*** | (2006.01) |

(52) U.S. Cl.
CPC ..... *A62B 3/005* (2013.01); *B25D 9/16* (2013.01); *B25D 2222/12* (2013.01)

(58) Field of Classification Search
CPC .... B25D 17/245; B25D 17/06; B25D 17/24; B25D 2216/0015; B25D 2217/0084; B25D 9/14; B25D 2250/375
USPC ..... 173/200, 204, 212
See application file for complete search history.

(56) References Cited

U.S. PATENT DOCUMENTS

| | | | |
|---|---|---|---|
| 4,750,568 | A | 6/1988 | Roxton et al. |
| 5,749,421 | A | 5/1998 | Johansson et al. |
| 5,770,809 | A | 6/1998 | Waterman |
| 5,775,440 | A | 7/1998 | Shinma |
| 5,921,327 | A | 7/1999 | Henriksson et al. |
| 5,944,118 | A | 8/1999 | Johansson et al. |
| 6,095,392 | A | 8/2000 | Batts, Jr. et al. |
| 7,328,753 | B2 | 2/2008 | Henriksson et al. |
| 2003/0173098 | A1 | 9/2003 | Miner et al. |

FOREIGN PATENT DOCUMENTS

| | | |
|---|---|---|
| CN | 2030934 U | 1/1989 |

*Primary Examiner* — Michelle Lopez
(74) *Attorney, Agent, or Firm* — Richard C. Litman

(57) ABSTRACT

The pneumatic hammer includes a hollow housing with handles for the user. A pneumatic driver is mounted inside the housing with an air tank for pressurized air. A reciprocating hammer assembly is slidably mounted inside the pneumatic driver and includes a hammer with a sharp hammer tip. The hammer is substantially hollow to efficiently capture released air from the air tank and drive the same. An alignment collar extends out of the housing and couples to the hammer assembly to set alignment of the hammer against an object to be impacted. The collar is normally locked in place. A control assembly is coupled to the housing, the pneumatic driver, and the collar to selectively release air driving the hammer out of the housing and unlock the collar for slidable movement into the housing.

11 Claims, 8 Drawing Sheets

PNEUMATIC HAMMER

BACKGROUND OF THE INVENTION

1. Field of the Invention

The present invention relates to emergency rescue devices, and particularly to a pneumatic hammer for easy, safe, and effective breaking of shatterproof glass.

2. Description of the Related Art

In emergency situations, such as fire emergencies and car accidents, time is a critical factor. Minutes or even seconds can make a difference between survival or death. Physical barriers preventing access to those in need are one of the biggest challenges to timely rescue efforts. Of these physical barriers, shatterproof glass (SG) is particularly difficult to penetrate during rescue operations.

Shatterproof glass, also called laminated glass, or safety glass, is usually designed with various formulations and laminates so that it can withstand most impacts. Many devices that are typically used for breaking such barriers can be used to form one or more cracks in the glass, but generally leave the integrity of the glass largely unchanged. Blunt instruments are the usual tools employed to break through the glass, but this type of glass is usually designed to withstand such impact, even after repeated blows. While this feature of shatterproof glass is desirable for security purposes, it becomes problematic in emergencies when it is imperative to intentionally break through the glass.

In light of the above, it would be a benefit in the art of emergency tools to provide a device that can penetrate shatterproof glass and similar objects effectively and in a timely manner. Thus, a pneumatic hammer solving the aforementioned problems is desired.

SUMMARY OF THE INVENTION

The pneumatic hammer includes a hollow housing with handles for the user. A pneumatic driver is mounted inside the outer housing with an air tank for pressurized air. A reciprocating hammer assembly is slidably mounted inside the pneumatic driver and includes a hammer with a sharp hammer tip. The hammer is substantially hollow to efficiently capture released air from air tank and drive the same. An alignment collar extends out of the housing and couples to the hammer assembly to set alignment of the hammer against an object to be impacted. The collar is normally locked in place. A control assembly is coupled to the housing, the pneumatic driver, and the collar to selectively release air to drive the hammer out of the housing and unlock the collar for slidable movement into the housing.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
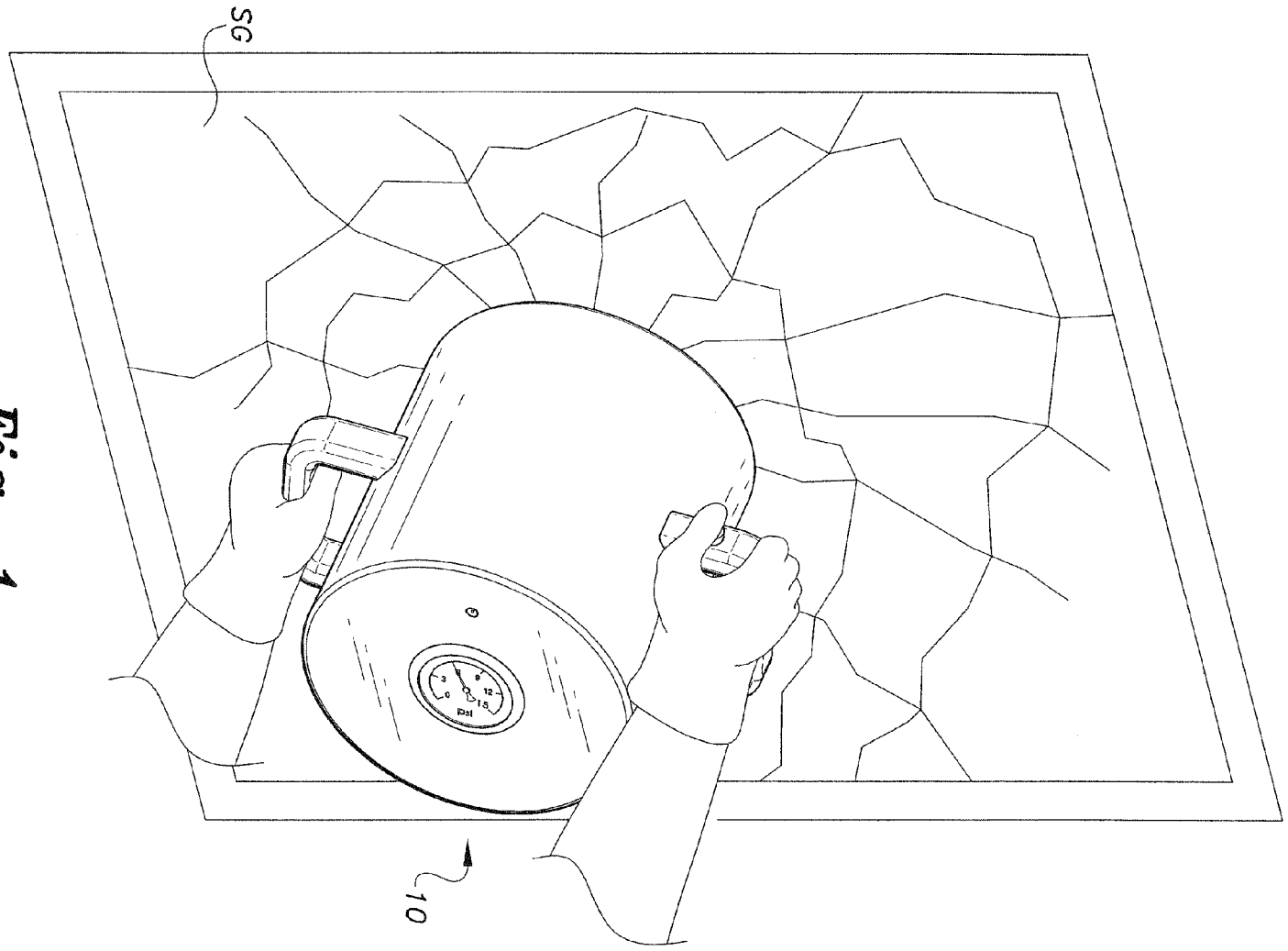
FIG. 1 is an environmental, perspective view of a pneumatic hammer according to the present invention.
Figure 2:
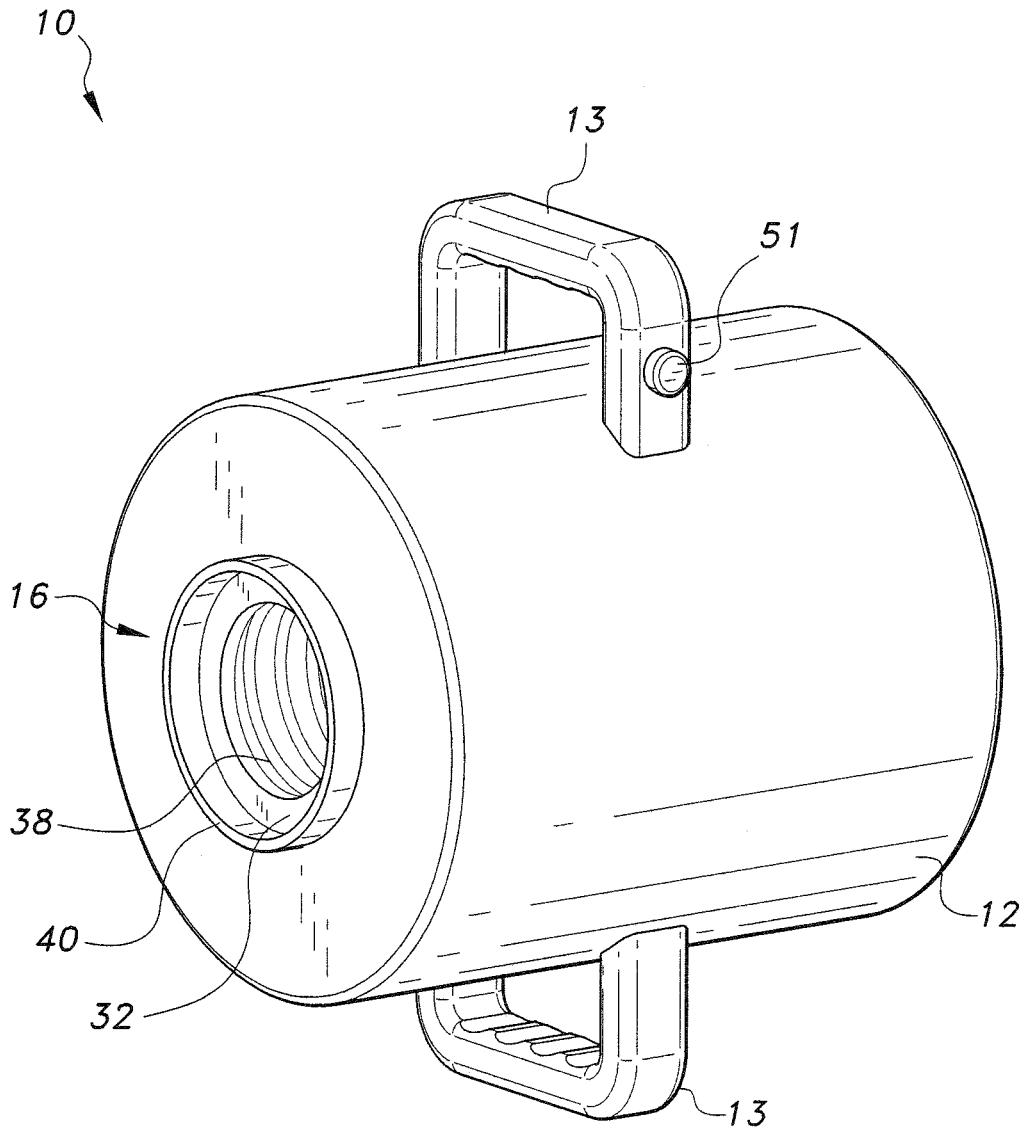
FIG. 2 is a front perspective view of the pneumatic hammer shown in FIG. 1.
Figure 3:
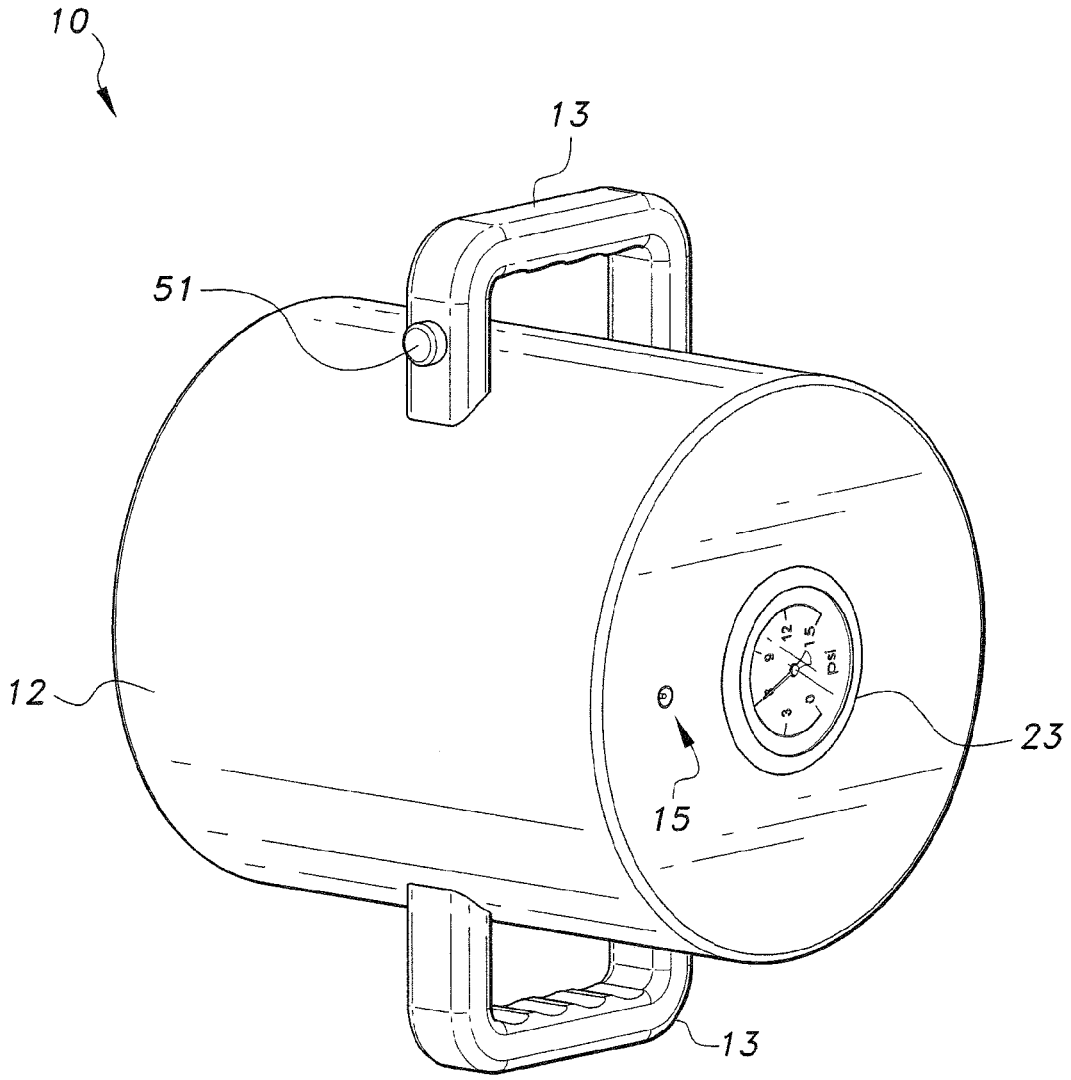
FIG. 3 is a rear perspective view of the pneumatic hammer shown in FIG. 1.

The pneumatic hammer, generally referred to by the reference number 10 in the Figures, provides a fast and efficient means of breaking through shatterproof glass (SG) and other durable objects, especially during emergency situations. As best seen in FIGS. 1-3 and 7, the pneumatic hammer 10 includes a hollow housing 12; an inner, pneumatic driver 20 disposed inside the housing 12; and a reciprocating hammer assembly 30 slidably mounted inside the pneumatic driver 20. A control assembly 50 coupled to the housing 12 selectively actuates the hammer assembly 30.

The housing 12 is generally an elongate hollow cylinder containing the pneumatic driver 20. A pair of handles 13 extends outwardly from the housing 12 to provide handholds for the user during use and transport. These handles 13 preferably extend from diametrically opposite sides of the housing 12, which is a more ergonomic and stable orientation for secure handling by the user. One or more of the handles 13 may be hollow to enable threading of control lines and other hardware for operation of the pneumatic hammer 10.

One end, or proximal end with respect to the user during use, includes a gauge opening 14 formed thereon. The gauge opening 14 enables installation or mounting of a pressure gauge 23 for the user to monitor operating pressure of the pneumatic hammer 10. A valve opening 15 is disposed proximate the gauge opening 14 to enable access to a relief valve 24*a* from the pneumatic driver 20. The opposite or distal end of the housing 12 also includes a hammer opening 16 through which a hammer 34 selectively extends during use. The hammer opening 16 is generally coaxial with respect to the gauge opening 14. However, the position of these openings can be varied depending on the application and configuration.

As best seen in FIGS. 4, 5, and 7-9, the pneumatic driver 20 includes an elongate, generally hollow, toroidal pressurized air tank 21 and a valve stem 24 extending axially from one end or proximal end of the air tank 21. The valve stein 24 houses a relief valve 24*a* enabling selective refills of gas, e.g., air, into the air tank 21 as well as to relieve excess pressure as necessary. The inner wall of the tubular air tank 21 can define an inner chamber 21*a* that opens to the environment inside the housing 12 when assembled. The inner chamber 21*a* can enable selective release of pressurized gas therethrough.

Figure 8:
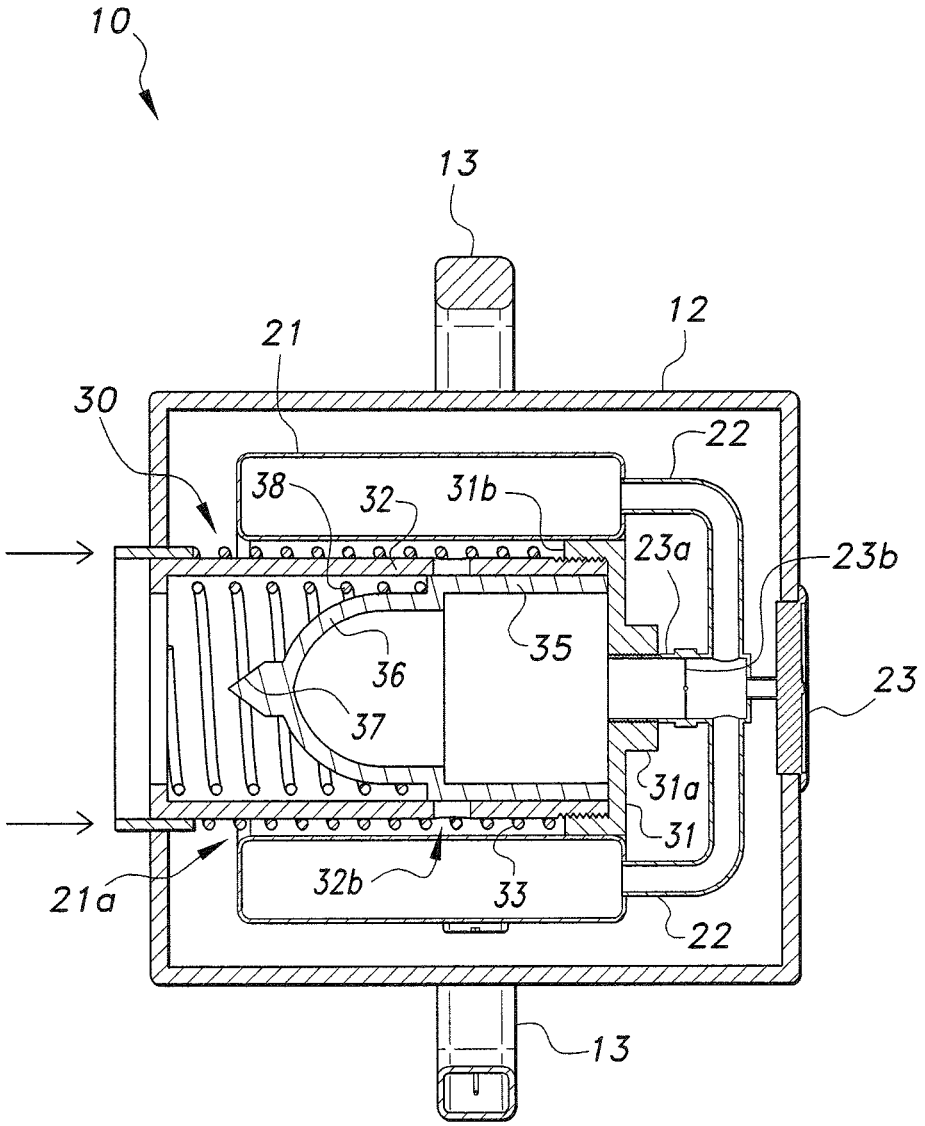
FIG. 8 is a sectional view of the pneumatic hammer shown in FIG. 1 at a ready, undeployed state.
Figure 9:
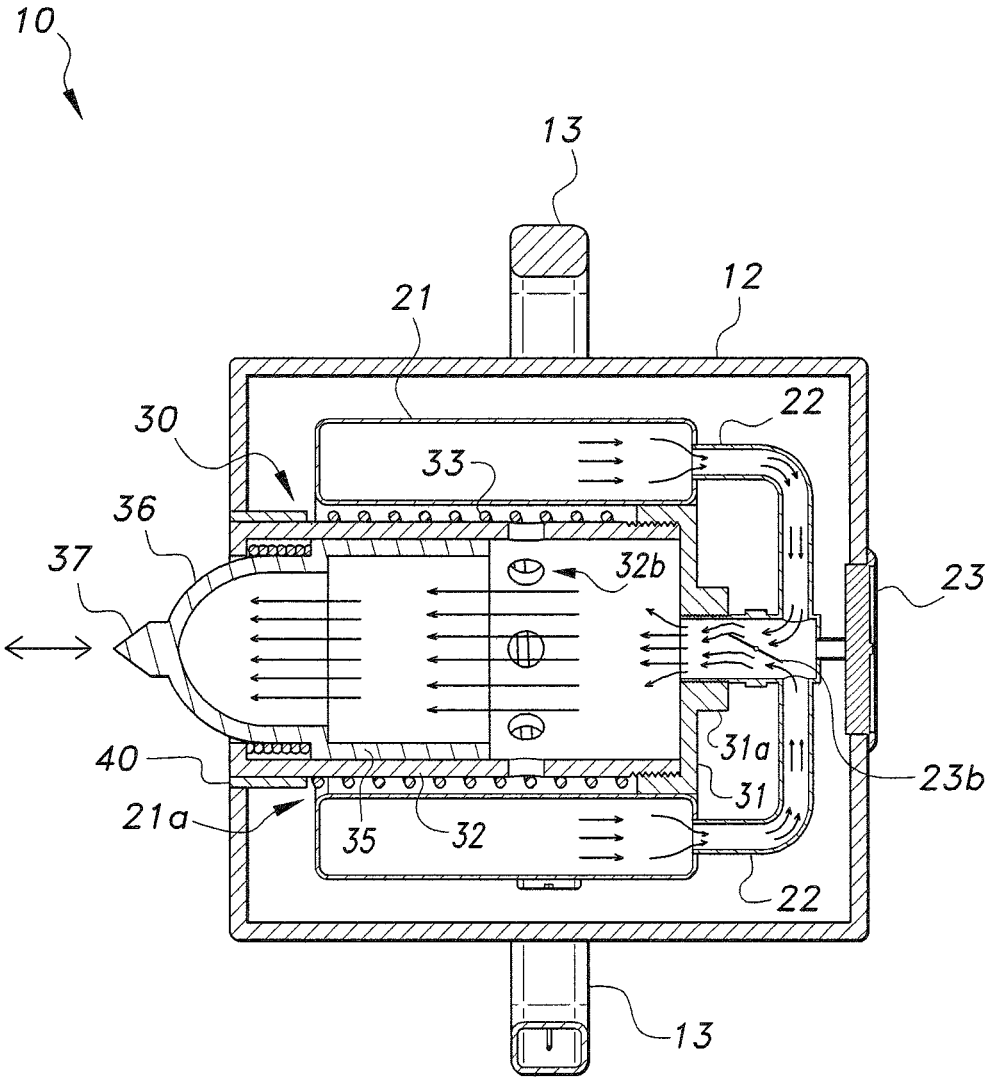
FIG. 9 is a sectional view of the pneumatic hammer shown in FIG. 1 at a deployed state.

A pair of elbow pipes 22 extends from diametrically opposite sides of the air tank 21 at the proximal end and couples to a connector pipe 23*a*, the connector pipe 23*a* being coupled to the pressure gauge 23 and extending axially therefrom. This connection of the elbow pipes 22 and the connector pipe 23*a* forms flow paths for the gas from the air tank 21 to escape into the inner chamber 21*a*. To control airflow into the inner chamber 21*a*, the connector pipe 23*a* includes a flapper valve 23*b* selectively operable by the control assembly 50. The flapper valve 23*b* is normally closed as shown in FIG. 8. When activated, the flapper valve 23*b* is opened as shown in FIG. 9 to permit pressurized gas to flow into the inner chamber 21*a*.

Selective release of gas drives the hammer assembly 30 slidably mounted inside the inner chamber 21*a*. As best seen in FIGS. 6-9, the hammer assembly 30 includes a generally circular or disk-shaped endcap 31 that caps or closes the proximal end of the air tank 21 and includes a connector hub 31*a* with inner threads for attaching the connector pipe 23*a* thereon. By this construction, one end of the hammer assembly 30 is supported by the connector pipe 23*a*. The endcap 31 is preferably constructed with relatively close tolerance with respect to the diameter of the inner chamber 21*a* so as to minimize air leaks during use. The endcap 31 may also be provided with seals such as O-rings and the like around the circumference to firmly seal the endcap 31 at the proximal end of the air tank 21. Alternatively, the endcap 31 may be fixed to the proximal end of the air tank 21 by any conventional means, such as via welds at or near the circumference, or the endcap 31 may be detachably mounted, such as via threaded connection at the circumference. The bore or opening of the inner threads in the connector hub 31*a* preferably extends completely through the thickness of the endcap 31 so as to form a passageway into the inner chamber 21*a*.

An elongate, cylindrical sleeve 32 is detachably mounted to the endcap 31. One end of the sleeve 32 is provided with threads 32*a* to secure the mounting. One or more spaced vent holes 32*b* are formed around the circumference of the sleeve 32. These vent holes 32*b* permit gas, e.g., air, to escape into the interior of the housing 12 during operation. A spring 33, such as a coil spring, slides over the sleeve 32 to have one end abut against a lip 31*b* at the distal end of the endcap 31. The opposite end of the sleeve 32 may be provided with an annular flange (not shown).

The reciprocating hammer 34 is slidably mounted inside the sleeve 32 in a biased manner. The hammer 34 is an elongate, generally hollow body with an elongate stem section 35 and a dome-shaped head section 36 extending coaxially, contiguous with respect to the stem section 35. The head section 36 has a smaller diameter than the stem section 35 and forms an outer, annular ledge where the two sections meet. As seen in FIGS. 8 and 9, both the stem section 35 and the head section 36 are hollow to efficiently capture the gas being expelled through the endcap 31. This action propels the hammer 34 out of the housing 12.

A hammer spring, such as a coil spring 38, slides over the head section 36 with one end resting against the annular ledge. The hammer spring 38 normally biases the hammer 34 into a ready position as shown in FIG. 8 when assembled, where the one end abuts against the annular ledge while the opposite end abuts an internal lip of the sleeve 32. The hammer spring 38 is preferably longer in coiled length compared to the head section 36 so that the natural bias of the hammer spring 38 pushes the hammer 34 towards the underside of the endcap 31. In the ready position shown in FIG. 8, the biasing force of the hammer spring 38 presses the open end of the stem section 35 against the endcap 31 to enable efficient capture of the gas being selectively expelled through the endcap 31 during use.

The head section 36 includes a hammer tip 37 extended coaxially therefrom. The hammer tip 37 is preferably chiseled, beveled, or tapered so as to end in a relatively sharp point that can penetrate and break the shatterproof glass SG with application of suitable force. Such a penetration and breakage usually weakens the shatterproof glass SG sufficiently to either remove a substantial portion of the shatterproof glass SG or require minimal additional blows to remove portions of the shatterproof glass SG. The hammer tip 37 is preferably constructed from tempered steel due to the hardness and durability of such a material. Other similar materials such as tungsten carbide and the like can also be used. Moreover, all or parts of the hammer 34 may be constructed from the same material.

The pneumatic hammer 10 is provided with an annular alignment collar 40 slidably mounted to the opening at the distal end of the housing 12. When assembled, the alignment collar 40 slides over the distal end of the sleeve 32 to support the opposite end of the hammer assembly 30. One end of the alignment collar 40 inside the housing 12 abuts against the opposite end of the spring 33. The alignment collar 40 covers the operating end of the pneumatic hammer 10 thereby providing a measure of safety. Moreover, the alignment collar 40 enables the user to place the operating end against the surface of the shatterproof glass SG at the preselected or desired target area to align the pneumatic hammer 10 for subsequent operation. In use, the user places the alignment collar 40 on the surface of the shatterproof glass SG and pushes against the bias of the spring 33 to form a seal around the target area. This insures that debris from the breaking glass will be substantially localized upon activation of the hammer assembly 30.

Figure 4:
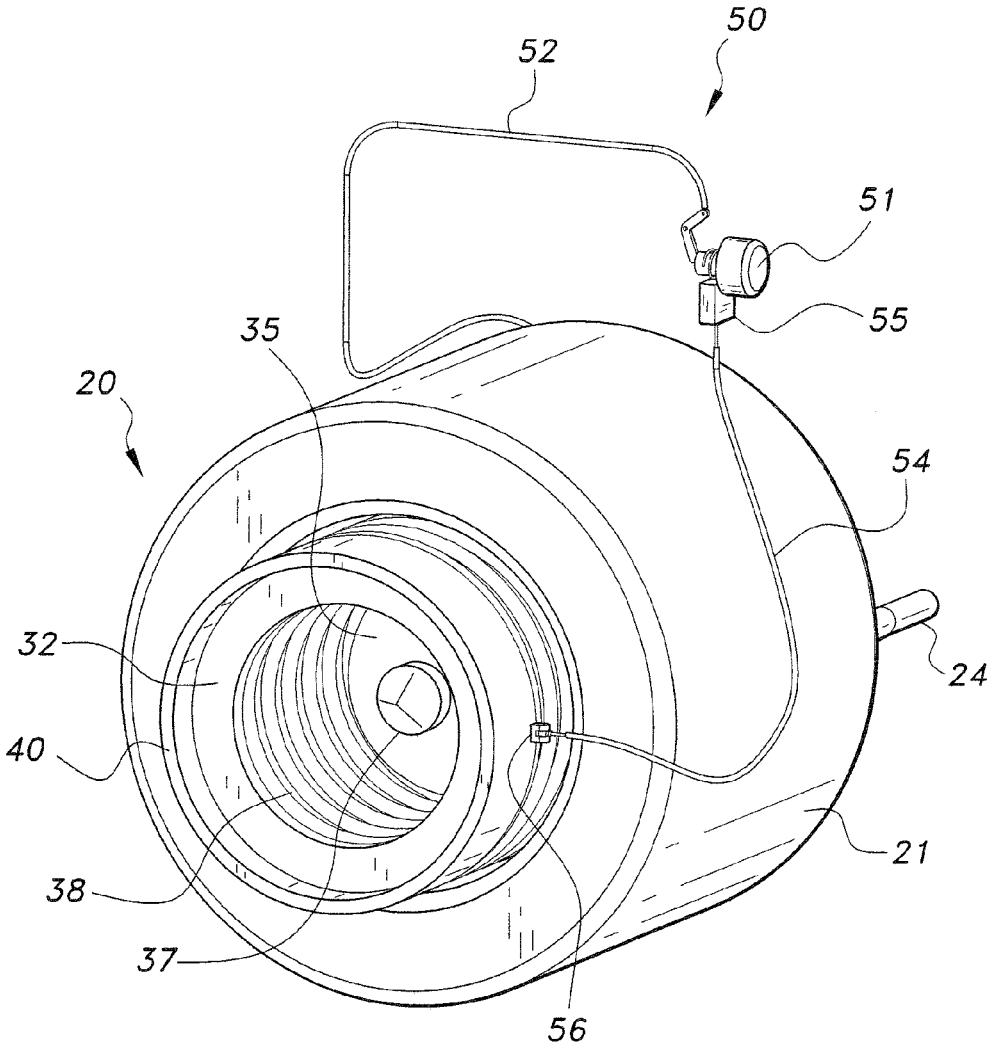
FIG. 4 is a front perspective view of the pneumatic hammer shown in FIG. 1 with an outer housing removed.
Figure 5:
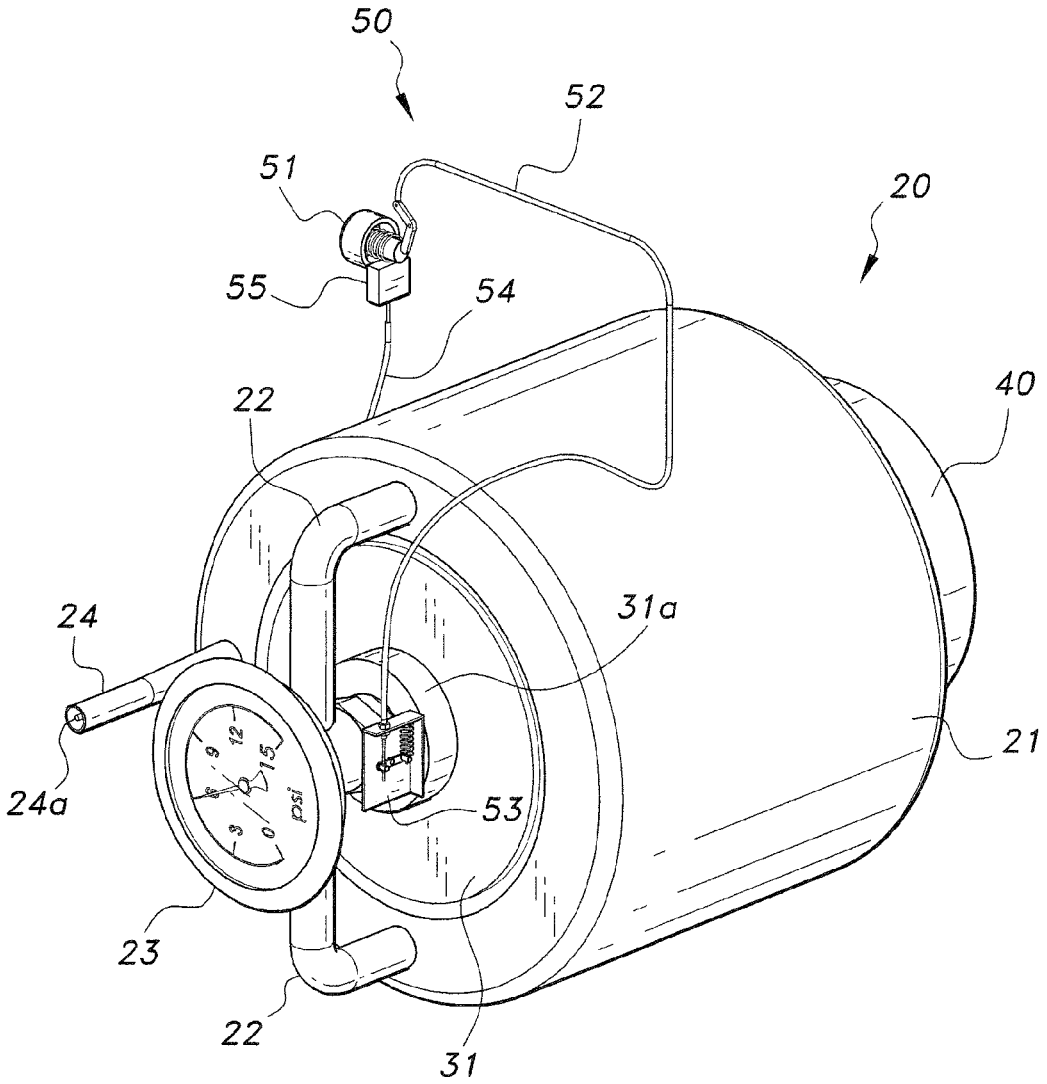
FIG. 5 is a front perspective view of the pneumatic hammer shown in FIG. 4.
Figure 6:
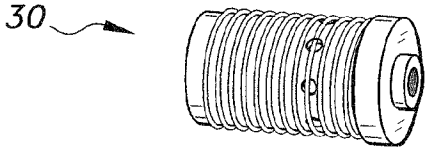
FIG. 6 is a perspective view of a biased hammer assembly for the pneumatic hammer shown in FIG. 1.
Figure 7:
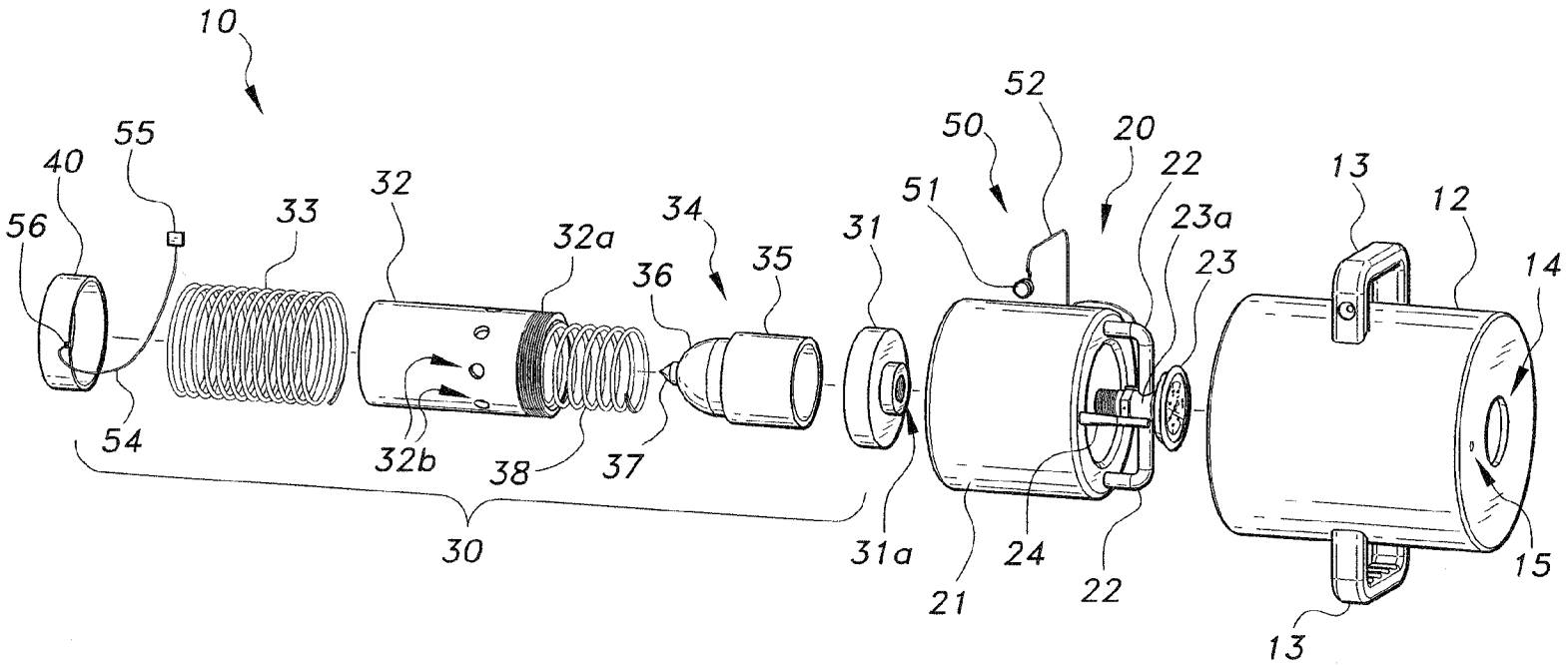
FIG. 7 is an exploded view of the pneumatic hammer shown in FIG. 1.

The control assembly 50 controls selective actuation of the hammer assembly 30 and operation of the alignment collar 40. As best seen in FIGS. 4, 5, and 7, the control assembly 50 includes a button 51 coupled to one of the pair of spaced handles 13. A valve control line 52 runs through the handle 13 and terminates at a valve actuator 53. The valve control line 52 may be a control cable. The valve actuator 53 is coupled to the flapper valve 23*b*. As shown in FIG. 8, the flapper valve 23*b* is normally closed, and a selective press of the button 51 causes the valve actuator 53 to open the flapper valve 23*b* as shown in FIG. 9. Release of the button 51 returns the flapper valve 23*b* to the normally closed state. In an embodiment, the valve actuator 53 may be a type of biased rocker arm that can be pivoted by movement of the valve control line 52.

The control assembly 50 also includes a means for locking the alignment collar 40 in place with respect to the housing 12. A lock control module 55 is coupled to the button 51, and a lock control line 54 extends from the lock control module 55 to a lock release unit 56. The lock release unit 56 may be a split ring lock that releases the alignment collar 40 upon activation of the button 51. In use, the alignment collar 40 is normally biased by the spring 33 to extend out of the housing 12 and locked in place by the lock release unit 56. Actuation of the button 51 causes simultaneous opening of the flapper valve 23*b* and release of the alignment collar 40 so that the alignment collar 40 may move against the bias of the spring 33 and retract into the housing 12 a certain extent. This action also provides a shock absorbing effect to the user as the user pushes the pneumatic hammer 10 against the surface being impacted by the hammer 34.

As best seen in FIGS. 1 and 9, the following describes the typical operation of the pneumatic hammer 10 and the air flow associated therewith. In use, the user places the alignment collar 40 against a surface of the shatterproof glass SG to align and seal the pneumatic hammer 10, and presses the pneumatic hammer 10 against the surface by the handles 13. The user then presses the button 51 which simultaneously causes the flapper valve 23*b* to open and release the alignment collar 40.

The air tank 21 contains pressurized air or other gas, and opening of the flapper valve 23*b* causes an almost explosive release of the air or other gas. The air flows into the hollow interior of the hammer 34 through the elbow pipes 22 and the connector pipe 23*a* creating high back pressure that drives the hammer 34 to slide out of the sleeve 32 and the housing 12. As back end of the hammer 34 slides along the sleeve 32 past the vent holes 32*b*, excess air is vented through the vent holes 32*b* so that the excess air can circulate inside the housing 12. If no venting exists, the relative high velocity of the hammer 34 can potentially damage the distal end of the sleeve 32 and/or prevent resetting of the hammer 34.

Once the impact has been completed, the hammer 34 returns to the normal ready state as shown in FIG. 8 due to the bias of the hammer spring 38. The spent air tank 21 can then be refilled via the relief valve 24*a* to a predetermined pressure, the pressure gauge 23 enabling monitoring of the desired pressure.

Thus, it can be seen that the pneumatic hammer 10 is a relatively simple and efficient device for quickly breaking shatterproof glass in emergency situations. The relatively sharp hammer tip 37 insures effective penetration into the pane of the glass and enables breakage.

It is to be understood that the pneumatic hammer 10 encompasses a variety of alternatives. For example, though the pneumatic hammer 10 has been described as pertaining to shatterproof glass, the pneumatic hammer 10 may also be used on other objects that require puncturing and/or breaking. Moreover, the pneumatic hammer 10 may be used in any situation where impact forces are necessary. The operating pressures for the pneumatic hammer 10 may be varied depending on the application. Furthermore, other gases such as nitrogen and the like may be used as the motive medium.

It is to be understood that the present invention is not limited to the embodiments described above, but encompasses any and all embodiments within the scope of the following claims.

I claim:

1. A pneumatic hammer, comprising:

an elongate, hollow housing, the housing having at least one handle extending outwardly therefrom;

a pneumatic driver disposed inside said housing, the pneumatic driver having an air tank adapted to be filled with pressurized gas;

a hammer assembly mounted inside the pneumatic driver, the hammer assembly having a hollow reciprocating hammer with a sharp hammer tip, the pneumatic driver having at least one pipe coupled to the hammer assembly to selectively drive the hammer, the hammer adapted to extend out of the housing to impact against an object and retract into the housing;

a reciprocating alignment collar coupled to the hammer assembly at one end of the housing, the alignment collar aligning placement of the pneumatic hammer against the object to be impacted by the hammer; and a control assembly coupled to the housing to selectively drive the hammer;

whereby selective release of the gas against the hammer builds back pressure to quickly drive the hammer against the object and break the same.

2. The pneumatic hammer according to claim 1, wherein said housing comprises:

an elongate hollow cylinder having a gauge opening and a valve opening at one end, the valve opening being in communication with a relief valve;

a pressure gauge mounted to said gauge opening; and a hammer opening formed at the opposite end, said hammer selectively extending through said hammer opening during activation by said control assembly, said collar being coupled to said hammer assembly through said hammer opening.

3. The pneumatic hammer according to claim 2, wherein said at least one handle comprises a pair of spaced, diametrically opposed handles.

4. The pneumatic hammer according to claim 2, wherein:

said at least one pipe has an elongate connector pipe coupled to said pressure gauge and said hammer assembly and a pair of spaced elbow pipes extending from one end of said air tank, each elbow pipe being coupled to said connector pipe;

a flapper valve is pivotally mounted inside said connector pipe, said flapper valve being selectively pivotable between a normally closed position and an open position by said control assembly; and a valve stem extending from one end of said air tank, the valve stem having a relief valve accessible through said valve opening for selective refilling of said air tank and relief of excess pressure.

5. The pneumatic hammer according to claim 4, wherein said control assembly comprises a selectively actuatable button disposed on said at least one handle, a valve control unit coupled to said flapper valve inside said connector pipe, and a control line extending from said button to said valve control unit; whereby selective actuation of said button opens said flapper valve to expel gas from said air tank into said hammer assembly to drive said hammer.

6. The pneumatic hammer according to claim 5, wherein said air tank comprises a hollow inner chamber for said hammer assembly.

7. The pneumatic hammer according to claim 4, wherein said hammer assembly comprises:

a substantially circular endcap at one end of said air tank, said endcap having a connector hub coupled to said connector pipe, said connector hub having a bore extending completely through said endcap to form an air passage with said connector pipe;

an elongate sleeve coupled to said endcap, said sleeve having outer threads at one end for mounting said sleeve to said endcap, at least one vent hole adjacent said outer threads to vent excess gas during operation, and an annular ledge at the opposite end of said sleeve, said annular ledge extending inwardly;

a spring slidably mounted around said sleeve, said spring having one end abutting said endcap;

said hammer slidably mounted inside said sleeve, said hammer being in communication with the air passage in said endcap to capture gas being expelled therethrough and propel said hammer during operation; and a hammer spring slidably mounted around said hammer, one end thereof abutting against a portion of said hammer, said hammer spring biasing said hammer to a normal ready position abutting said endcap.

8. The pneumatic hammer according to claim 7, wherein said hammer comprises an elongate hollow stem section having a diameter, a substantially dome-shaped hollow head section extending coaxially contiguous with said stem section, said head section having a diameter smaller than the diameter of the hollow stem to form an annular ledge, and said hammer tip extending coaxially from said head section.

9. The pneumatic hammer according to claim 8, wherein said control assembly comprises a selectively actuatable button disposed on said at least one handle, a lock control module coupled to said button, a lock release unit coupled to said alignment collar, said alignment collar having one end coupled to said sleeve and abutting the end of said hammer spring, and a control line extending from said lock control module to said lock release unit, wherein selective actuation of said button unlocks said alignment collar to facilitate slidable movement of said alignment collar into said housing against the bias of said hammer spring.

10. The pneumatic hammer according to claim 8, wherein said hammer tip is constructed from hardened steel.

11. The pneumatic hammer according to claim 1, wherein said hammer tip is constructed from hardened steel.

* * * * *